US007108128B2

(12) United States Patent
Borg

(10) Patent No.: US 7,108,128 B2
(45) Date of Patent: Sep. 19, 2006

(54) BALANCED MULTIPLE CONTAINER CARRIER

(75) Inventor: Zakary J. Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 0 days.

(21) Appl. No.: 11/102,362

(22) Filed: Apr. 8, 2005

(65) Prior Publication Data

US 2005/0167289 A1 Aug. 4, 2005

Related U.S. Application Data

(63) Continuation-in-part of application No. 10/602,371, filed on Jun. 23, 2003, now abandoned.

(51) Int. Cl.
*B65D 75/00* (2006.01)

(52) U.S. Cl. ..... 206/150; 206/151; 294/87.2; 294/159

(58) Field of Classification Search ..... 206/150, 206/162, 163, 164, 141, 148, 159, 427, 151, 206/199; 294/87.2, 159
See application file for complete search history.

(56) References Cited

U.S. PATENT DOCUMENTS

| | | | | |
|---|---|---|---|---|
| 3,036,853 | A * | 5/1962 | Glazer | 294/87.2 |
| 4,093,295 | A * | 6/1978 | Erickson | 206/150 |
| 5,443,298 | A * | 8/1995 | Finley et al. | 206/159 |
| 5,735,562 | A * | 4/1998 | Borg | 294/159 |
| 6,715,810 | B1 * | 4/2004 | Borg | 294/87.2 |
| 6,789,828 | B1 * | 9/2004 | Borg | 294/87.2 |

* cited by examiner

*Primary Examiner*—Luan K. Bui
(74) *Attorney, Agent, or Firm*—Chernoff, Vilhauer, McClung & Stenzel, LLP

(57) ABSTRACT

An integrally molded carrier for balanced lifting and carrying of multiple containers by their necks includes a substantially planar web having multiple nodes defining multiple aligned annular support rings, the web being provided with a flexibly attached U-shaped handle attached to one side of the web. Annular neck-engaging flanges integral with the web are arranged around the inside of the support rings for releasably engaging the necks of containers.

9 Claims, 4 Drawing Sheets

BALANCED MULTIPLE CONTAINER CARRIER

This is a continuation-in-part of application Ser. No. 10/602,371 filed Jun. 23, 2003, now abandoned, the priority of which is claimed pursuant to 35 USC 120.

BACKGROUND OF THE INVENTION

Multiple bottle carriers for holding and carrying bottles or jugs by their necks are well known. A common type of commercially available carrier is fabricated from thin gauge sheets of plastic. The thin planar sheet is die-cut to provide holes for engaging the necks of the containers and holes for grasping the carrier, and is thermo-formed into a three-dimensional shape to provide structural integrity to the carrier. There are several problems with this carrier. First, the thermo-formed plastic sheet shrouds the container, obscuring visibility of the product and product labels. Second, the thin gauge and sharp edges of the plastic material makes the carrier uncomfortable to carry.

An integrally molded carrier for carrying multiple containers by their necks is disclosed in commonly owned U.S. Pat. No. 6,129,397. The carrier disclosed therein is designed to carry six large bottles, typically one-gallon plastic jugs containing a liquid such as milk, fruit juice or water. While such products are sold in bulk in packs of six, it is advantageous from a pricing standpoint for retailers to sell 64 ounce or half-gallon bottles three to a package.

Carrying handles for three or four bottles, however, are awkward and difficult to use. An example of such a carrier is shown in U.S. Pat. No. 4,093,295, which discloses an in-line design bottle carrier capable of carrying three bottles by their necks by means of three uniformly spaced split collars mounted within a frame interconnected by a single row of longitudinally extending rigid bars. The carrier features two loops that function as handles, which must be pulled up substantially simultaneously and drawn together before they may be grasped by the user, making the balanced lifting of three bottles awkward. These handles also tend to stick up above the necks of the bottles, making the bottle/carrier combination difficult to ship. Finally, the '295 carrier is also difficult to apply to groups of three bottles with automated equipment.

BRIEF SUMMARY OF THE INVENTION

The present invention provides an integrally molded carrier for balanced lifting and carrying of up to three or four containers by their necks. The carrier includes a substantially planar web having three or four nodes defining three or four annular support rings. A flexible annular neck-engaging flange integral with the web is arranged within each annular support ring for releasably engaging the necks of containers. The centers of the annular support rings are substantially aligned along a common axis. A substantially U-shaped handle is flexibly attached to one side of the web at points on either side of the center annular support(s), and is capable of lying in the same plane as the web.

The web design and the flexibility of the single handle at its points of attachment to the web provide a balanced carrier that enables up to three or four containers to be lifted by hand and easily carried. The design also permits the three or four containers to be balanced relative to the handle so that their weight is distributed evenly. Finally, the planar configuration of the carrier when not in use permits high speed machine application of the carrier to sets of bottles and allows multiple carriers to be easily stacked together for shipping.

DETAILED DESCRIPTION OF PREFERRED EMBODIMENTS

Figure 1:
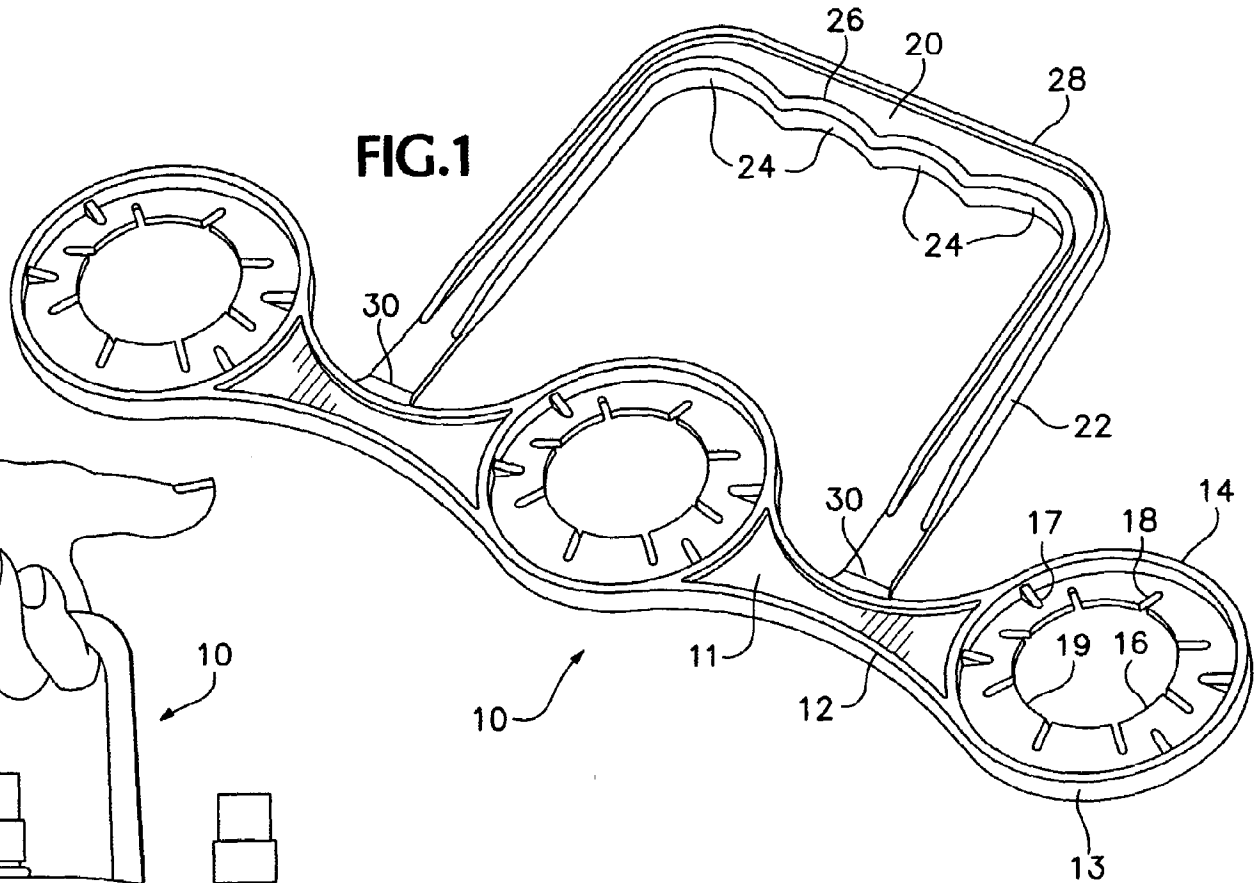
FIG. 1 is a perspective top view of an exemplary carrier of the invention.

Referring to the drawings, wherein like numerals generally refer to the same elements, there is shown in FIGS. 1–4 carriers 10 and 10' for carrying up to three or four containers such as bottles that include a substantially planar web 11 having three or four nodes preferably formed from a flexible material such as plastic, preferably high density polyethylene (HDPE), and most preferably recyclable HDPE. The three or four nodes of web 11 are substantially aligned along a common axis.

Web 11 includes an inner portion which is continuous and flat and optional peripheral support ridges 12 along its periphery between the three or four nodes to provide structural rigidity. Each of the three or four nodes are provided with identical flexible neck-engaging annular support rings 13 that are integral with web 11.

Each neck-engaging annular support ring 13 is provided with a circumferential ridge 14 to give structural rigidity, and with an annular flange 16. Annular flange 16 is flexible for ease in placing over and removing the same from, for example, a bottle neck, and may be joined to circumferential ridge 14 by radial ribs 17. Annular flange 16 is preferably frusto-conically shaped so as to flex in an upward direction when the carrier is pushed in a downward direction over, for example, the necks of bottles and then to bear at an upward angle against the weight of the bottles when the carrier is lifted. Annular flange 16 is optionally provided with inner edge portions 19 that are substantially flat, which make it easier to engage and disengage bottle necks. Annular flange 16 may also be provided with sets of reinforcing radial ribs 17 and sets of radial relief slots 18, the latter permitting the annular flanges greater flex when the necks of bottles are either engaged or disengaged. Annular flange 16 may also be discontinuous or articulated, shown by the reference A in FIG. 3, to facilitate the carrying of heavier bottles, and outer neck-engaging rings 13 may be provided with pry tabs 32 to further facilitate application and removal of rings 13 to and from the necks of bottles.

Other types of neck-engaging flanges may work as well. For example, flat flanges, not conically shaped, may have enough structural rigidity to grasp and hold the necks of bottles. Nor is it necessary that the flanges be set apart from the annular supporting ribs by radial ribs; the web and the flanges may be integral if the web material is strong enough.

Figure 2:
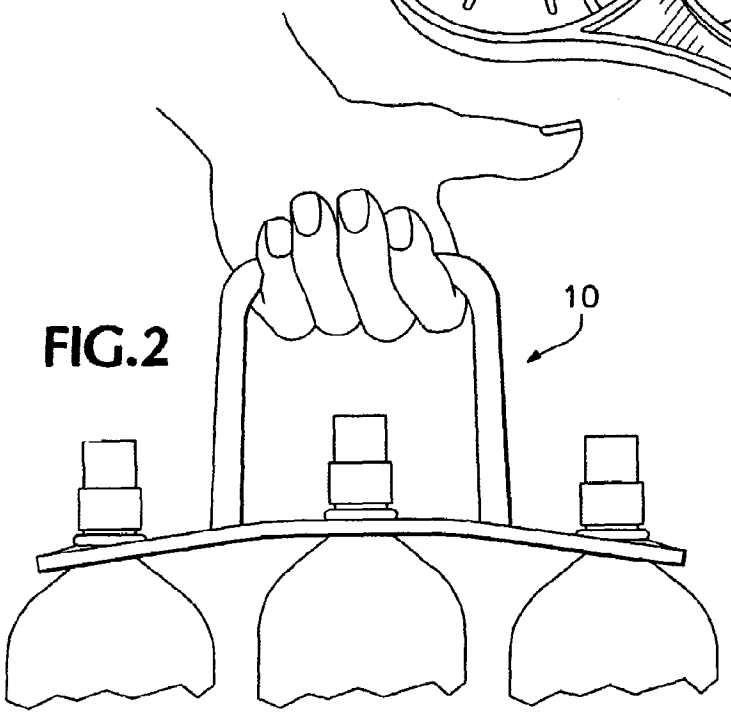
FIG. 2 is a side view of the carrier of FIG. 1 engaging three containers by their necks and showing the handle oriented at substantially right angles to the web.
Figure 3:
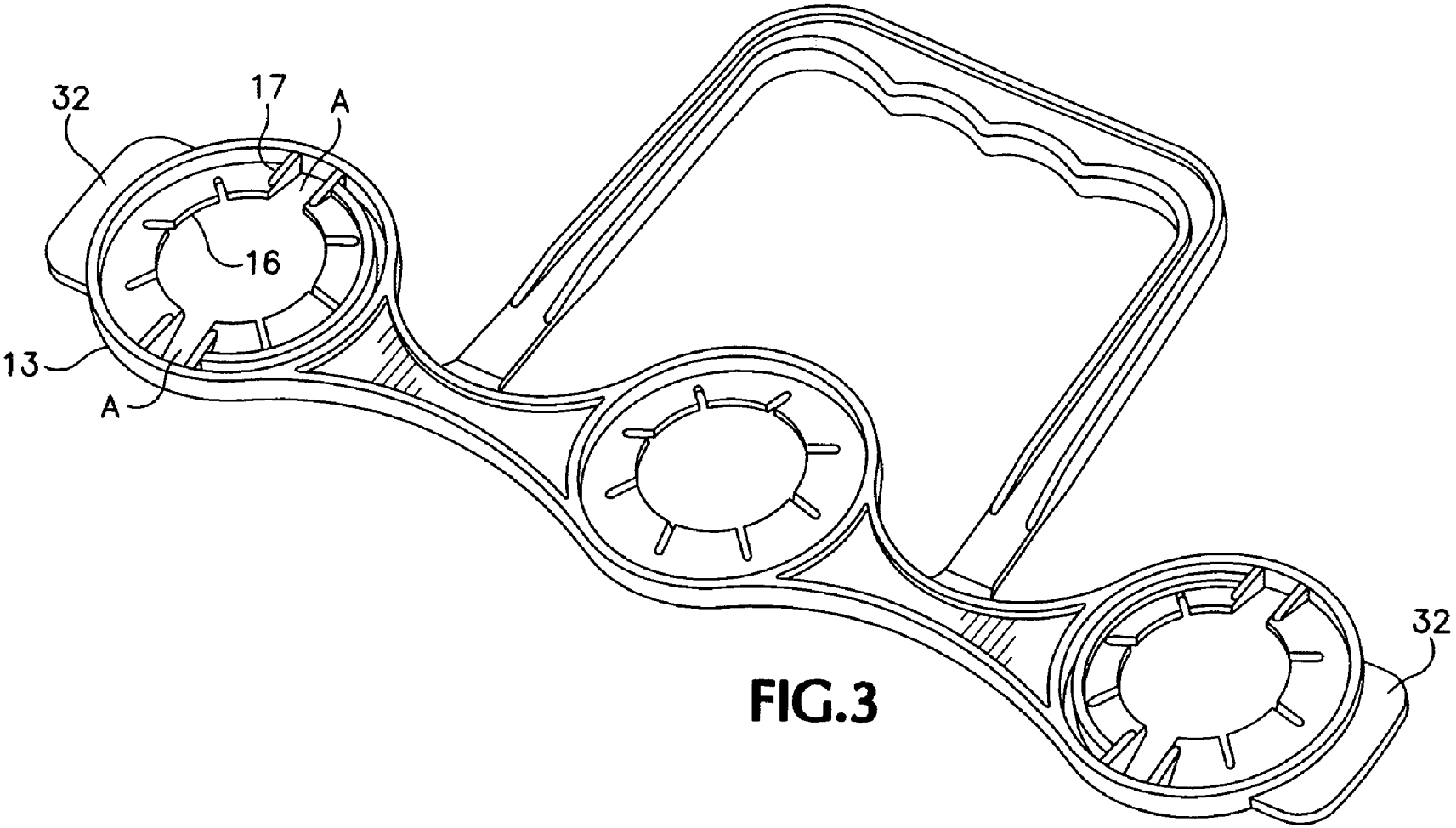
FIGS. 3–4 are perspective top views of two other exemplary carriers of the invention.
Figure 4:
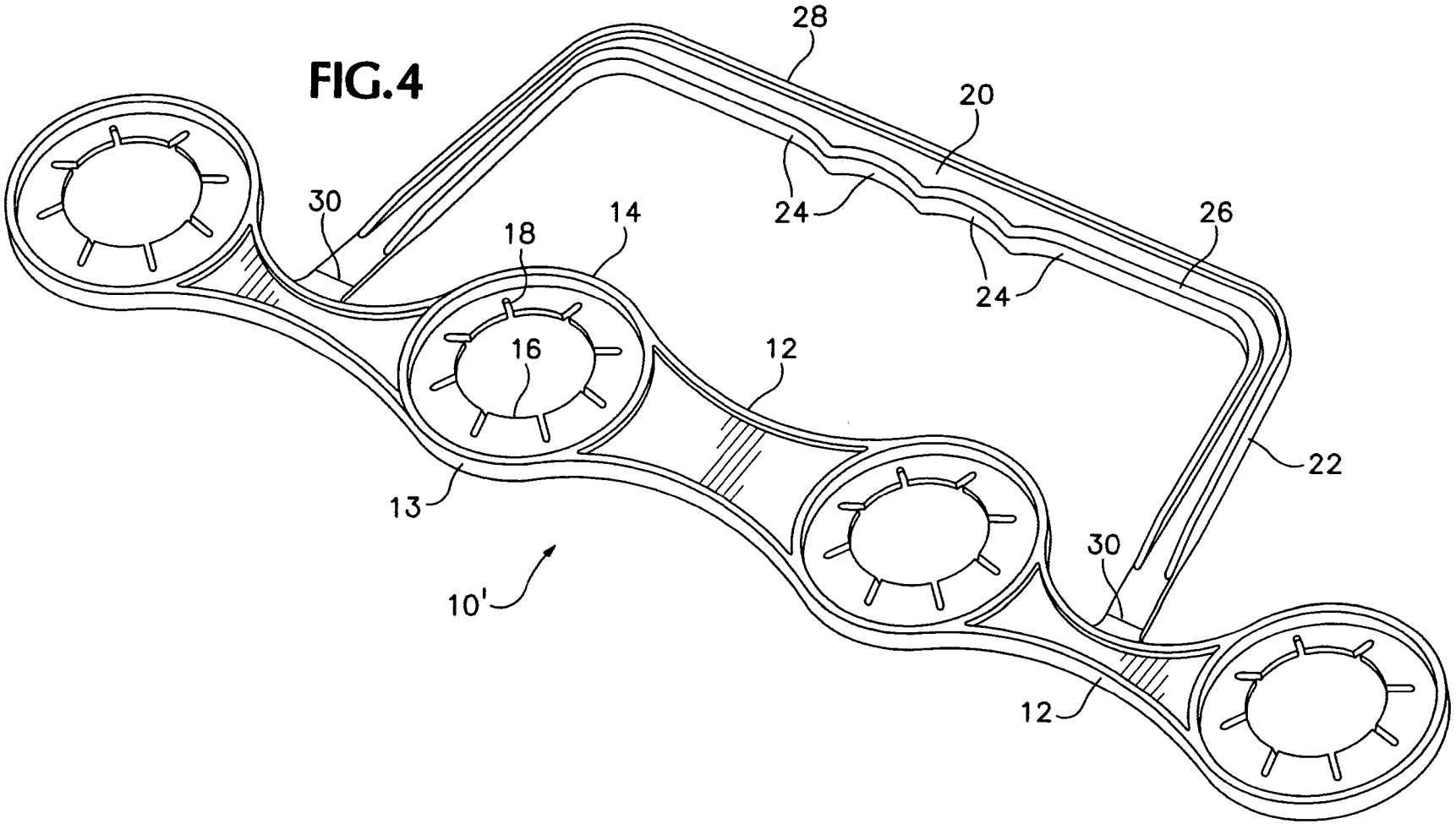

The carrier 10 and 10' is provided with a generally U-shaped handle 20 that has two arms 22 and a grip portion 24. Handle 20 is optionally reinforced with inner and outer reinforcing ribs 26 and 28, respectively. Handle 20 is flexibly attached to one side of web 11 on either side of the center neck-engaging ring(s) 13 and substantially equidistantly between the centers of the three or four neck-engaging rings 13 at the flex points 30. Because of its attachment to one side of web 11, handle 20 may lie in the same plane as the web when not in use, thereby facilitating stacking multiple carriers for shipment and for feeding carriers to high speed machine applications to sets of bottles. Flex points 30 are preferably aligned with the common axis of both (i) the three or four nodes and (ii) annular support rings 13 so as to provide an axial balance point for the carrier. Because of its flexible attachment at two points, handle 20 is free to pivot about 90° relative to web 11 and annular support rings 13 without twisting, which promotes a balanced lift and carry. This is shown in FIG. 2, which depicts carrier 10 in use.

Figure 5:
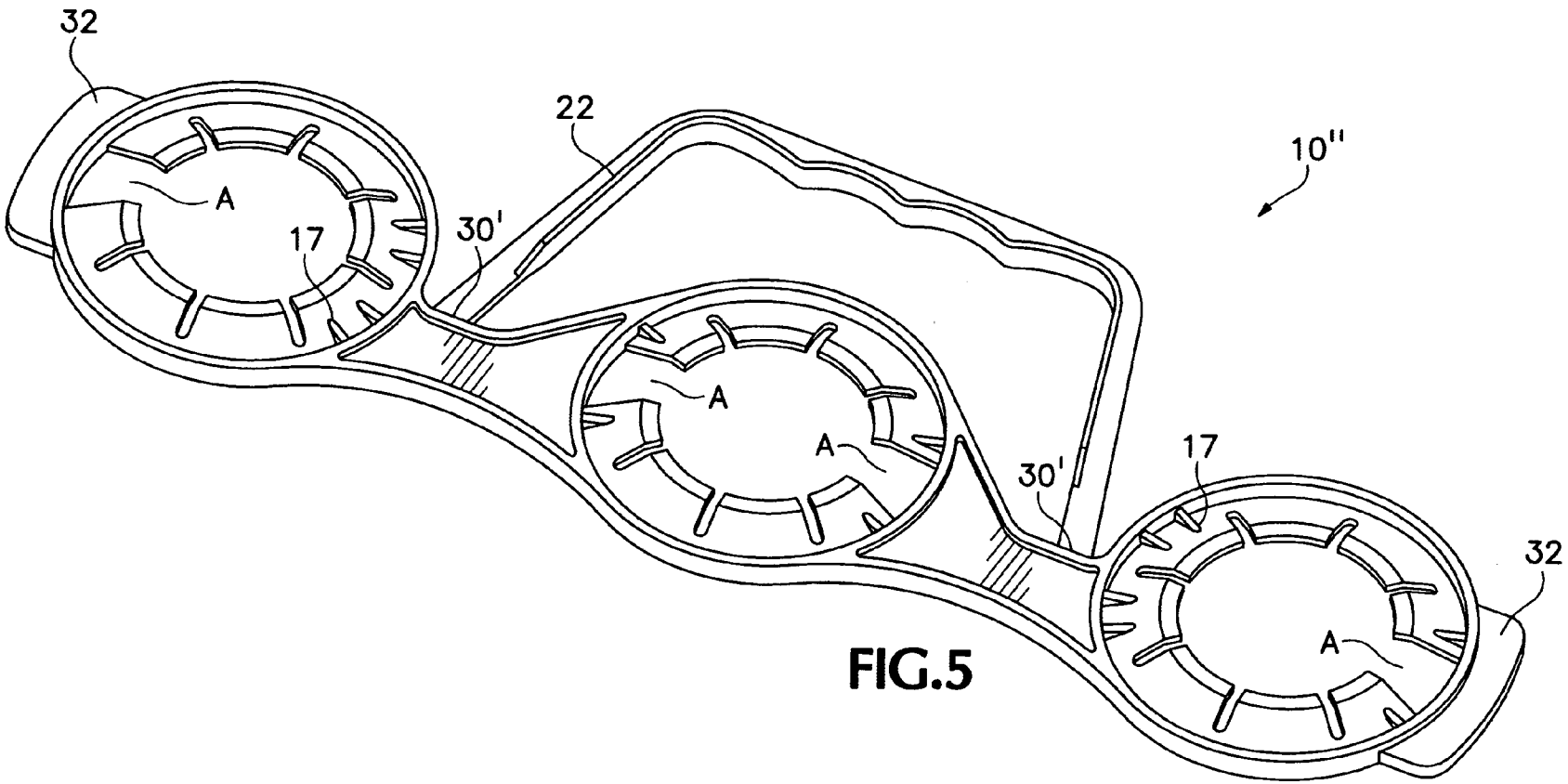
FIG. 5 is a perspective top view of another exemplary carrier of the invention.

Another embodiment of the inventive carrier is depicted as carrier 10" in FIG. 5, wherein U-shaped handle 20 is flexibly attached to web 11 at two flex points 30' that are substantially immediately adjacent the two outboard or distal annular support rings 13, the flex points being substantially aligned with both (i) the common axis of the three nodes and (ii) the annular support rings 13. Handle 30 may be provided with a single inner reinforcing rib 26. Annular flanges 16 are also preferably provided with at least one discontinuity A.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

The invention claimed is:

1. An integrally molded carrier for carrying multiple containers by their necks, comprising a substantially planar web having two distal and one central annular supports with each annular support having a flexible annular flange provided with a plurality of radial slots and at least one discontinuity for releasably engaging the necks of the containers, wherein the centers of said annular supports are substantially aligned along a common axis, and a single generally U-shaped handle flexibly attached to said web at two flex points on one edge of said web, said two flex points being adjacent to said two distal annular supports and being substantially aligned with said common axis.

2. The carrier of claim 1 wherein said two distal annular supports are provided with tabs.

3. The carrier of claim 2 wherein said flexible annular flange is provided with radial ribs extending inwardly of said annular supports.

4. The carrier of claim 3 wherein said flexible annular flange comprises a frusto-conical portion.

5. The carrier of claim 4 wherein said flexible annular flange includes substantially flat inner edge portions.

6. The carrier of claim 5 wherein said annular supports are provided with circumferential ridges.

7. The carrier of claim 6 wherein said web is provided with ridges along its periphery.

8. The carrier of claim 7 made of high density polyethylene.

9. The carrier of claim 7 wherein said high density polyethylene is recyclable.

* * * * *